US005490527A

United States Patent [19]

Irikura et al.

[11] Patent Number: 5,490,527

[45] Date of Patent: Feb. 13, 1996

[54] APPARATUS FOR SAMPLING FILTER CIGARETTES DURING THE MANUFACTURER THEREOF

[75] Inventors: Takayuki Irikura; Makoto Kakiuchi, both of Tokyo, Japan

[73] Assignee: Japan Tobacco Inc., Tokyo, Japan

[21] Appl. No.: 350,008

[22] Filed: Nov. 29, 1994

Related U.S. Application Data

[63] Continuation of Ser. No. 110,941, Aug. 24, 1993, abandoned.

[30] Foreign Application Priority Data

Aug. 24, 1992 [JP] Japan ..... 4-224145

[51] Int. Cl.[6] ..... A24C 5/60

[52] U.S. Cl. ..... 131/280; 131/907; 131/908; 198/339.1; 209/535

[58] Field of Search ..... 131/94, 280, 907, 131/908; 198/339–341; 73/863.91, 863.92; 209/535–537

[56] References Cited

U.S. PATENT DOCUMENTS

| | | | |
|---|---|---|---|
| 3,492,874 | 2/1970 | Marradi . | |
| 4,962,771 | 10/1990 | Neri et al. | 131/94 X |
| 5,209,249 | 5/1993 | Neri | 131/907 X |
| 5,232,079 | 8/1993 | Belcaslro et al. | 198/438 X |

FOREIGN PATENT DOCUMENTS

| | | |
|---|---|---|
| 2540351 | 8/1984 | France . |
| 2551632 | 3/1985 | France . |
| 3232792 | 3/1983 | Germany . |
| 58-245608 | 12/1983 | Japan . |
| 166464 | 3/1989 | Japan . |
| 2216767 | 10/1989 | United Kingdom . |

*Primary Examiner*—Jennifer Bahr

[57] ABSTRACT

A sampling apparatus of the present invention comprises a sampling drum located in the vicinity of a drum train of a filter attachment, a suction carrier arranged on the outer peripheral surface of the sampling drum and having a sampling groove, a suction channel in the sampling drum for supplying a suction pressure to the sampling groove, and a shutter in the sampling drum for opening and closing the suction channel, the sampling groove periodically approaching one of filter cigarettes transported on the drum train as the sampling drum rotates.

9 Claims, 7 Drawing Sheets

APPARATUS FOR SAMPLING FILTER CIGARETTES DURING THE MANUFACTURER THEREOF

This application is a continuation of application Ser. No. 08/110,941 filed on Aug. 24, 1993, now abandoned.

BACKGROUND OF THE INVENTION

1. Field of the Invention

The present invention relates to an apparatus for sampling filter cigarettes for quality inspection during the manufacture of the filter cigarettes.

2. Description of the Related Art

When a cigarette rod, which is twice as long as a cigarette, is supplied to a filter cigarette manufacturing apparatus or a so-called filter attachment, it is cut into two equal parts or individual cigarettes. Then, a filter plug is supplied between these cigarettes. A paper piece is wound around the two cigarettes and the plug to connect them, thus forming a double filter cigarette. Thereafter, the double filter cigarette is cut in the center into individual filter cigarettes.

As these processes are executed, cigarette rods, cigarettes, and double filter cigarettes are transported continuously in the filter attachment.

The filter attachment is provided with a filter cigarette sampling apparatus for periodical quality inspection. Examples of this sampling apparatus are described in Published Unexamined Japanese Patent Applications Nos. 59-162868 and 1-277478.

The sampling apparatus described in Published Unexamined Japanese Patent Applications No. 59-162868 comprises a sampling drum for taking out filter cigarettes by continuous suction during transportation, while the one described in Published Unexamined Japanese Patent Applications No. 1-277478 comprises a sampling drum for taking out filter cigarettes by selective suction.

In the case of the former sampling apparatus, the filter cigarettes are continuously sampled as they are transported, so that the filter cigarette sampling may possibly be subject to a bias.

In the latter case, the selective suction of the filter cigarettes during transportation requires proper intermittent supply of suction pressure to the sampling drum, and a solenoid valve is used for this intermittent supply. Since the sampling drum and the solenoid valve are located at a distance from each other, however, a time lag is entailed before a substantial suction pressure is supplied to the sampling drum even though the valve is opened. Accordingly, proper control of the timing for the switching operation of the solenoid valve, which is required by accurate filter cigarette sampling, is very difficult. The higher the operating speed of the filter attachment, that is, the higher the speed of filter cigarette transportation in the filter attachment, moreover, the more carefully the lag of the switching operation of the solenoid valve itself should be considered for appropriate filter cigarette sampling.

SUMMARY OF THE INVENTION

The object of the present invention is to provide an apparatus easily applicable to a high-speed filter attachment and capable of selectively sampling filter cigarettes during transportation without damaging the cigarettes.

The above object is achieved by a sampling apparatus of the present invention. This sampling apparatus is incorporated in a filter cigarette manufacturing system, which includes a drum train formed of a plurality of transportation drums continuous with one another and transporting cigarettes and manufactured filter cigarettes in a manner such that the cigarettes and the filter cigarettes are successively delivered between the transportation drums, a first transportation drum, out of the transportation drums, transporting the filter cigarettes while attracting the filter cigarettes under a first suction pressure.

The sampling apparatus comprises: a sampling drum rotatably arranged in the vicinity of the first transportation drum, the sampling drum having a sampling groove capable of cyclically approaching one of the filter cigarettes transported on the first transportation drum to receive the filter cigarette while the sampling drum is rotating; supply means for supplying a second suction pressure to the sampling groove as the sampling groove passes a predetermined rotational angle zone on the side of the first transportation drum while the sampling drum is rotating, the supply means including a suction channel defined in the sampling drum and connected to the sampling groove; differential pressure means for producing a differential pressure between the first suction pressure on the first transportation drum and the second suction pressure on the sampling groove as the sampling groove passes the rotational angle zone, the filter cigarettes on the first transportation drum being attracted and received by the sampling groove on the basis of the differential pressure; release means for removing the second suction pressure on the sampling groove after the rotational angle zone is passed by the sampling groove; and collecting means for collecting the filter cigarette in the sampling groove from the sampling drum after the second suction pressure on the sampling groove is removed.

According to the sampling apparatus described above, when the sampling groove cyclically approaches the first transportation drum while the sampling drum is rotating, the sampling groove attracts and receives the filter cigarette from the first transportation drum. When the rotation of the sampling drum advances so that the sampling groove gets out of the rotational angle zone and is released from the second suction pressure, thereafter, the filter cigarette in the sampling groove is collected from the sampling groove or the sampling drum by the collecting means.

Thus, the aforesaid filter cigarette sampling is repeated every time the sampling groove makes one revolution.

In the case where the sampling apparatus is provided with valve means for opening and closing the suction channel of the supply means, the valve means closes the suction channel, thereby stopping the second suction pressure supply to the sampling groove, that is, the filter cigarette sampling, when a predetermined number is attained by the number of sampled filter cigarettes.

Since the suction pressure is utilized for the filter cigarette sampling, the filter cigarettes cannot be damaged by the sampling.

Even though the above-described system or the filter attachment is designed for higher-speed operation such that the rotating speed of the transportation drum is increased, the filter cigarette sampling from the first transportation drum can be secured by only increasing the rotating speed of the sampling drum with the increase of the rotating speed of the first transportation drum.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
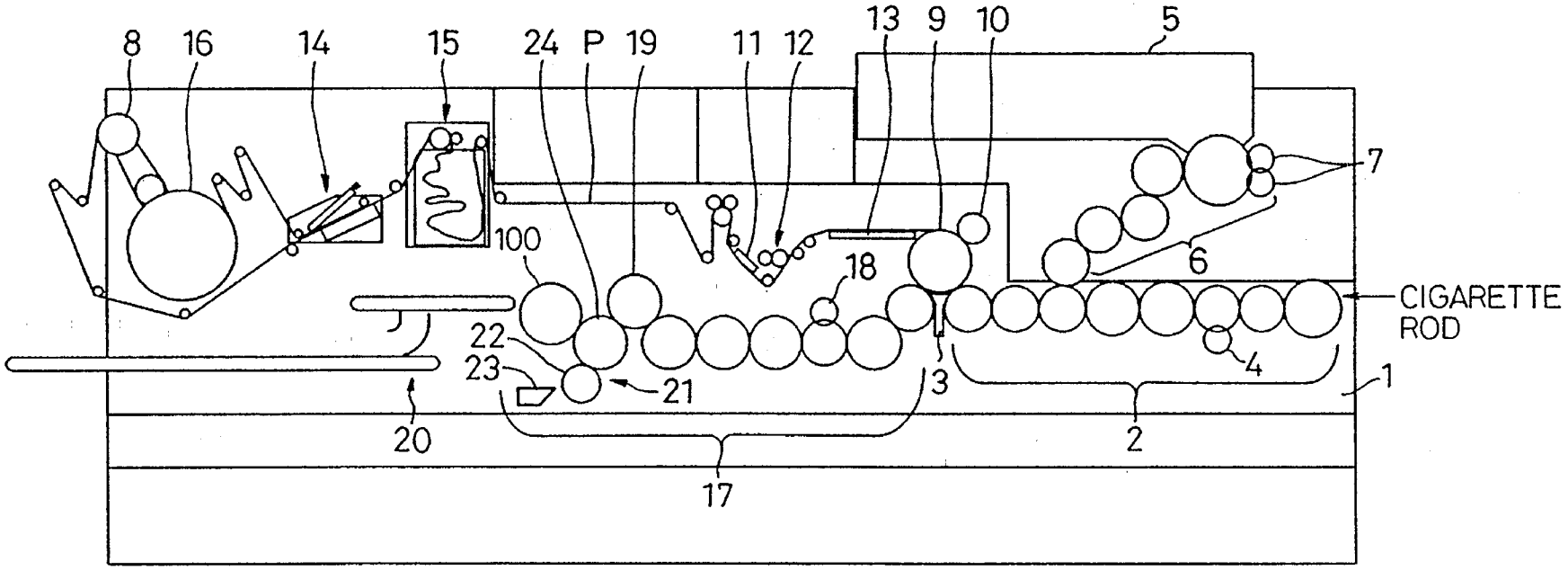
FIG. 1 is a schematic view showing a filter attachment.

A filter attachment shown in FIG. 1 comprises an upright main frame 1. The main frame 1 is provided with a drum train 2 which extends to the left from the right-hand end thereof as in FIG. 1. The left-hand end of the drum train 2 is connected to a rolling section 3.

The drum train 2 includes a number of transportation drums, which are arranged in a row, and a number of suction grooves are formed on the outer peripheral surface of each drum. The grooves are arranged at regular intervals in the circumferential direction of the drum. Cigarette rods are fed to that transportation drum which is situated at the starting end of the drum train 2, and are held in the suction grooves of the drum by suction. As this transportation drum rotates, the cigarette rods in the groove are transported. The cigarette rods are delivered from the right-hand one of each two adjacent transportation drums to the left-hand one, as in FIG. 1. Thus, the cigarette rods are transported towards the rolling section 3 as they are repeatedly transferred between the individual transportation drums of the drum train 2. An example of the transportation drum will become apparent from the description of a sampling device, which will be mentioned later.

Each cigarette rod fed to the drum train 2 is twice as long as a cigarette. In the process of transportation on the drum train 2, the cigarette rod is cut into two equal parts or cigarettes by means of a rotating circular knife 4, and thereafter, a predetermined space is secured between these two cigarettes. Thus, the rolling section 3 is supplied successively with pairs of cigarettes having the predetermined space between them.

Figure 2:
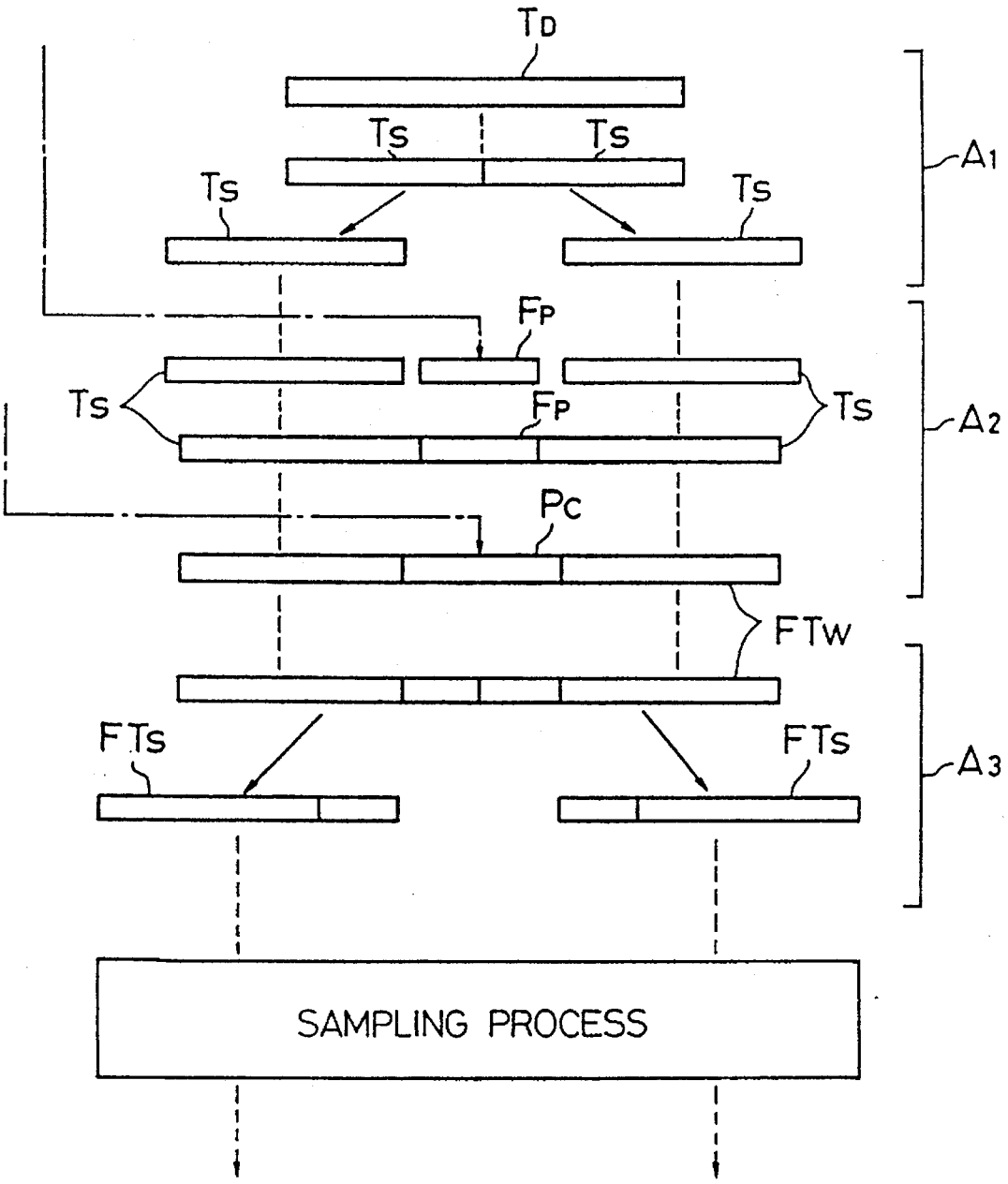
FIG. 2 is a diagram showing a flow of processing of cigarettes in the filter attachment.

The aforementioned processing is represented by a region $A_1$ in FIG. 2. In this region, $T_D$ and $T_S$ indicate a cigarette rod and cigarette, respectively.

A hopper 5 is located over the drum train 2. The hopper 5 and the drum train 2 are connected to each other by means of a drum train 6, which resembles the drum train 2. A number of filter rods are stored in the hopper 5. The drum train 6 takes out the filter rods one by one from the hopper 5, and transports them to the drum train 2.

During this transportation, each filter rod is cut into a plurality of equal parts or individual filter plugs by means of rotating circular knives 7. As these filter plugs on the same axis pass a grading drum, which constitutes one transportation drum in the drum train 6, they are rearranged in front and in rear with respect to the transportation direction thereof. Thereupon, each filter plug is fed from the drum train 6 to the space between each two cigarettes transported on the drum train 2.

On the drum train 2, thereafter, the two cigarettes are brought individually into intimate contact with the opposite ends of the filter plug, whereupon they are supplied to the rolling section 3. In the rolling section 3, a paste-backed paper piece is wound around the two cigarettes and the filter plug. By doing this, the two cigarettes and the filter plug are connected to one another, whereupon a double filter cigarette is formed.

The paper piece is obtained by cutting a paper web P, which is paid out from a roll 8 at the left-hand end portion of the main frame 1. The supplied paper web P is guided to a receiving drum 9, which is situated right over the rolling section 3, and is attracted to the peripheral surface of the drum 9. Located in the vicinity of the receiving drum 9 is an edged drum 10 which serves to cut the paper web P in cooperation with the drum 9. The receiving drum 9 and the edged drum 10 rotate in opposite directions. As the paper web P passes between the drums 9 and 10, it is cut into paper pieces on the receiving drum 9 by the edged drum 10. As the receiving drum 9 rotates, thereafter, these paper pieces are fed to the rolling section 3. Blades (not shown) of the drum 10 can cut the paper web P in a manner such that they are not in contact with the peripheral surface of the receiving drum 9.

In a feed path for the paper web P between the roll 8 and the receiving drum 9, a preheater 11, a paster 12, and a post-heater 13 are successively arranged downstream in the region on the drum side. In the region on the roll side, a paper web connecting section 14 and a paper web storage section 15 are successively arranged downstream. A paper web paid out from a standby paper roll 16 is previously guided to the connecting section 14.

The processing from the supply of the filter plugs to the winding of the paper pieces is represented by a region $A_2$ in FIG. 2. In this region, $F_P$, $P_C$ and $FT_W$ indicate a filter plug, paper piece, and double filter cigarette, respectively.

A drum train 17, which resembles the aforesaid drum trains 2 and 6, extends to the left from the rolling section 3. The drum train 17 receives the double filter cigarette from the rolling section 3 and transports it. During the transportation, the double filter cigarette is cut in the center of its filter plug by means of a rotating circular knife 18, whereby two filter cigarettes are produced. Thereafter, a predetermined space is secured between these two filter cigarettes. This processing is represented by a region $A_3$ in FIG. 2. In this region, $FT_S$ indicates each filter cigarette.

As the individual filter cigarettes thus formed are transported on the drum train 17, they pass an inspection drum 19 which constitutes one transportation drum in the drum train 17. The inspection drum 19 checks each passing filter cigarette for the winding state of its paper piece. If the winding of any paper piece is found to be nonconforming by this inspection, the defective filter cigarette is removed from the drum train 17.

A belt conveyor 20 is connected to the terminal end of the drum train 17. The conveyor 20 receives the filter cigarettes from the drum train 17, and feeds them to a packaging machine in the next stage.

Incorporated in the drum train 17 is a sampling device 21 for sampling the formed filter cigarettes. This sampling device 21 is provided with a sampling drum unit 22 and a pair of receiving trays 23.

In the drum train 17, the drum unit 22 is situated on the downstream side of the inspection drum 19 with one transportation drum 24 between the unit 22 and the drum 19.

Figure 3:
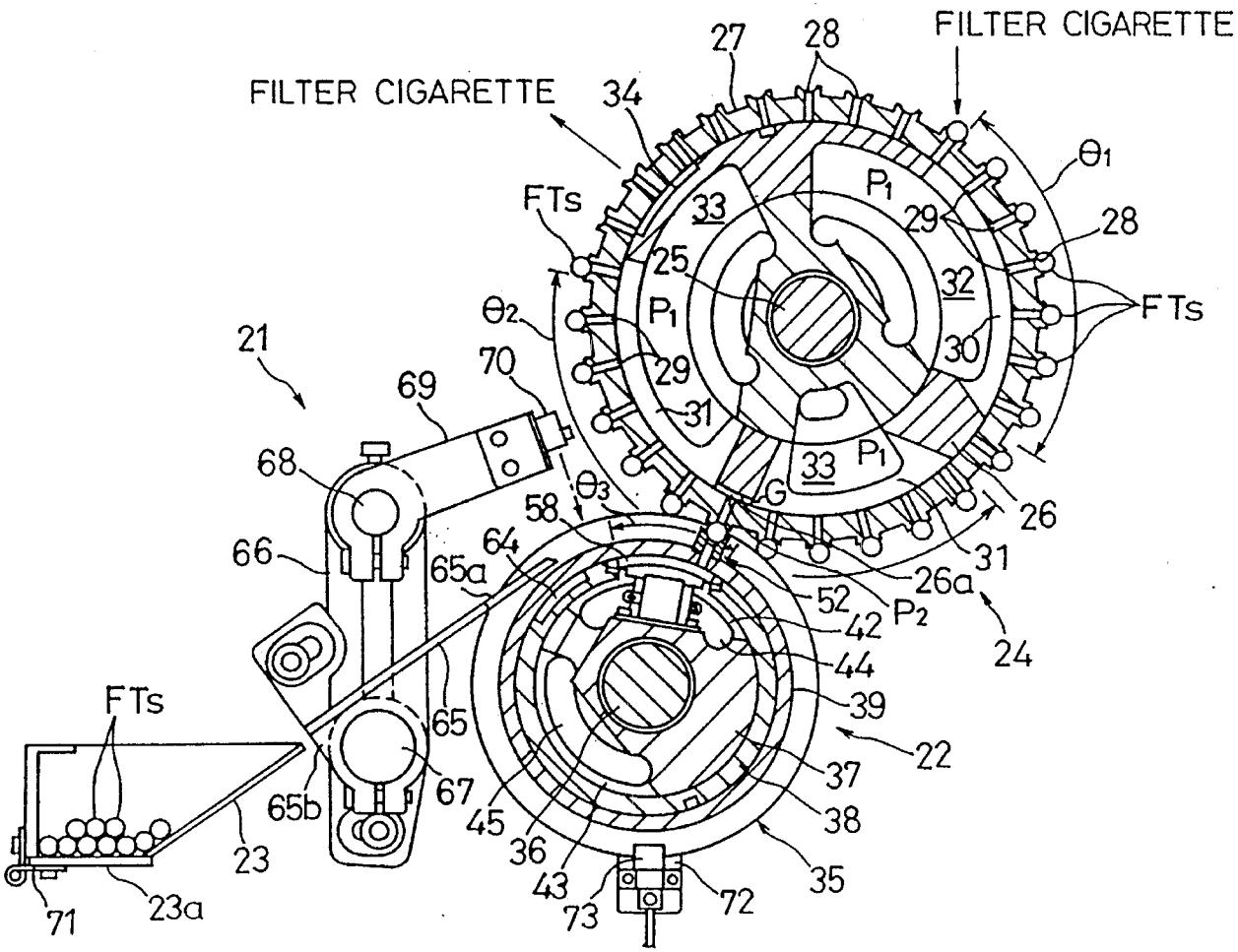
FIG. 3 is a cross-sectional view showing a sampling drum and a transportation drum.

Before explaining the drum unit 22, the transportation drum 24 will be described. As shown in FIG. 3, the transportation drum 24 comprises a drive shaft 25 in its center, a stationary sleeve 26, and a drum shell 27, the sleeve 26 and the shell 27 successively surrounding the shaft 25. An annular gap is secured between the stationary sleeve 26 and the drive shaft 25. As seen from FIG. 3, the sleeve 26 has a dual structure.

The drum shell 27, which is airtightly mounted on the stationary sleeve 26, rotates in sliding contact with the outer peripheral surface of the sleeve 26. A rotatory force for the drum shell 27 is transmitted from the drive shaft 25. More specifically, the drive shaft 25 and the drum shell 27 are connected to each other by means of a coupling system (not shown), and the shell 27 is rotated in the clockwise direction of FIG. 3.

A number of ribs are formed on the outer peripheral surface of the drum shell 27. These ribs, which extend in the axial direction of the drum shell 27, are arranged at regular intervals in the circumferential direction of the shell 27. Each rib is divided in the middle with respect to the axial direction of the drum shell 27 so that a pair of coaxial projections are obtained from each rib.

Each projection is formed having a suction groove 28, so that the outer peripheral surface of the drum shell 27 has left- and right-hand rows of suction grooves 28 arranged in the circumferential direction thereof. Each suction groove 28 has an arcuate cross section, and extends in the axial direction of the drum shell 27. One end of each of suction holes 29 opens in the bottom of each suction groove 28, and the other end of each hole 29 in the inner peripheral surface of the drum shell 27. The suction holes 29 radially extend toward the center of the drum shell 27.

On the other hand, suction channels 30 and 31 are independently formed on the outer peripheral surface of the stationary sleeve 26. The suction channel 30 extends over a first rotational angle zone $\theta_1$, in the rotating direction of the drum shell 27, from a point at which the shell 27 and the inspection drum 19 approaches each other with respect to the rotating direction of the shell 27, that is, an angular position in which the two filter cigarettes are received from the drum 19. The suction channel 31, which is separated from the suction channel 30 by a partition wall, extends over a second rotational angle zone $\theta_2$ in the rotating direction of the drum shell 27.

A release groove 34 is formed on the outer peripheral surface of the stationary sleeve 26. The groove 34 is situated just in front of the suction channel 31 with respect to the rotating direction of the drum shell 27 and is communicated with the atmosphere as mentioned later.

The suction channels 30 and 31 always communicate with suction passages 32 and 33 in the stationary sleeve 26. The channels 30 and 31 are connected to a common negative-pressure source (not shown) such as a blower. Thus, a line suction pressure $P_L$ is continually supplied from the negative-pressure source to these suction passages 32 and 33, that is, the suction channels 30 and 31.

Further, the stationary sleeve 26 is provided with a throttle wall **26*a* which is located in the suction channel 31. The wall 26*a*, which extends in the axial direction of the sleeve 26, divides the suction channel 31 into two regions with respect to the rotating direction of the drum shell 27. These regions communicate with each other through a narrow gap G defined between the throttle wall 26*a* and the inner peripheral surface of the drum shell 27**.

Although the suction channel 31 is connected to the negative-pressure source by means of the suction passage 33, air in the gap G cannot be easily sucked out, so that a first suction pressure $P_1$ in the gap G is lower than the line suction pressure $P_L$.

When the suction grooves 28 in the left- and right-hand rows are successively met with suction grooves (not shown) on the side of the inspection drum 19 as the drums 19 and 24 rotate, they are connected to the suction channel 30 via the suction holes 29, individually. On the other hand, the supply of suction pressure to the suction grooves of the inspection drum 19 is already canceled. Accordingly, the pairs of filter cigarettes $FT_S$, transported on the inspection drum 19, are attracted and received from the suction grooves thereof by the left- and right-hand suction grooves 28, and thereafter, are transported as the drum shell 27 rotates. The attractive hold of the filter cigarette $FT_S$ on the drum shell 27 is continued as long as the suction holes 29 of the suction grooves 28 communicate with the suction channels 30 and 31, and is canceled when the suction holes 29 open into the release groove 34.

When the suction holes 29 of the suction grooves 28 open into the release groove 34, the filter cigarettes $FT_S$ in the grooves 28 are attracted and received from the transportation drum 24 by suction grooves of a transportation drum 100 (see FIG. 1), which adjoins the drum 24 on the downstream side thereof. As the drum 100 rotates, the filter cigarettes $FT_S$ are transported toward the belt conveyor 20.

The drum unit 22 comprises a sampling drum 35. As seen from FIG. 3, the drum 35 is located closest to the transportation drum 24 when it is in an angular position facing the second rotational angle zone $\theta_2$ of the drum 24, or more specifically, the throttle wall **26*a* of the stationary sleeve 26** or the gap G.

Figure 4:
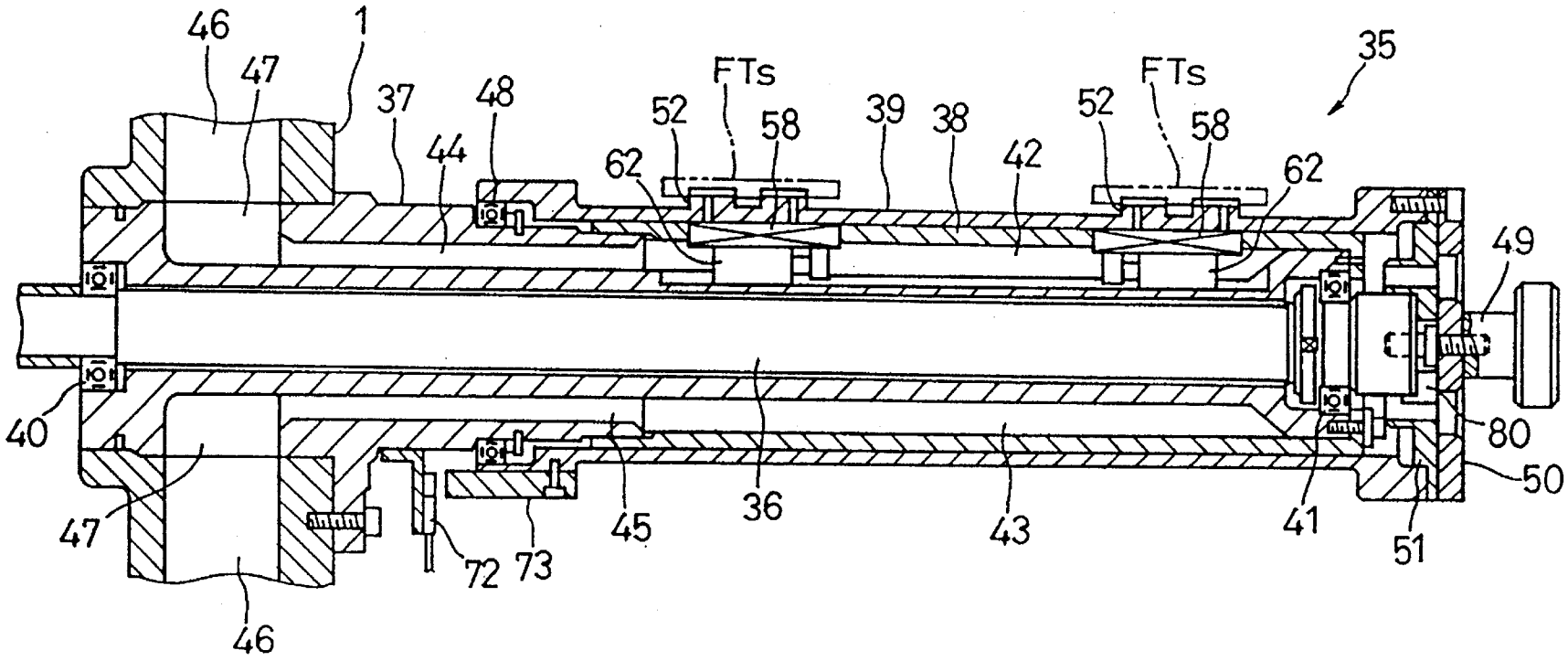
FIG. 4 is a longitudinal sectional view of the sampling drum.

As shown in FIGS. 3 and 4, the sampling drum 35, like the transportation drum 24, comprises a drive shaft 36 in its center, a stationary sleeve 37, a control sleeve 38, and a drum shell 39, the sleeves 37 and 38 and the shell 39 successively surrounding the shaft 36. An annular gap is secured between the drive shaft 36 and the stationary sleeve 37.

As seen from FIG. 4, the drive shaft 36 is rotatably supported inside the stationary sleeve 37 by means of a pair of bearings 40 and 41. The stationary sleeve 37 is supported by the main frame 1 in a manner such that its one end portion is fitted in the frame 1. On the other hand, the drive shaft 36 projects from the one end of the sleeve 37 into the inside of the main frame 1, and is connected to a power transmission system (not shown). Thus, the shaft 36 is rotated in one direction by means of power from the power transmission system.

The other end portion of the stationary sleeve 37 protrudes horizontally from the main frame 1, and a pair of suction channels 42 and 43 are formed on the outer peripheral surface of this portion. These channels 42 and 43, which extend in the circumferential direction of the sleeve 37, are separated from each other. The suction channels 42 and 43 also extend in the axial direction of the stationary sleeve 37. As seen from FIG. 3, the one suction channel 42 is situated on the side of the transportation drum 24.

A pair of bores 44 and 45 are formed inside the one end portion of the stationary sleeve 37. These bores 44 and 45 communicate at one end with the suction channels 42 and 43, respectively, while their respective other ends are connected to a suction passage 46 in the main frame 1 through connecting holes 47. The bores 44 and 45 have the shape of a circular arc, as viewed in the cross section of the stationary sleeve 37, that is, in FIG. 3.

The suction passage 46 is connected to a negative-pressure source (not shown) such as a blower. This negative-pressure source continually supplies a second suction pressure $P_2$ to the inside of the paired suction channels 42 and 43 through the suction passage 46, connecting holes 47, and bores 44 and 45. The second suction pressure $P_2$ may be set on a level higher than that of the first suction pressure $P_1$, e.g., on the same level with the line suction pressure $P_L$. In this case, a common negative-pressure source may be used for both the transportation drum 24 and the sampling drum 35.

The control sleeve 38, which is fixedly mounted on the outer peripheral surface of the stationary sleeve 37, airtightly covers the paired suction channels 42 and 43 of the stationary sleeve 37. An inner flange is formed on that end of the control sleeve 38 which is situated on the other end side of the stationary sleeve 37, and the control sleeve 38 is fixed to the stationary sleeve 37 by means of the inner flange.

The drum shell 39, which is airtightly mounted on the control sleeve 38, can rotate in sliding contact with the sleeve 38. One end of the shell 39 extends beyond the control sleeve 38 toward the main frame 1, and is rotatably supported on the stationary sleeve 37 by means of a bearing 48. The other end portion of the drum shell 39 also axially extends beyond the inner flange of the control sleeve 38.

The respective other ends of the drum shell 39 and the drive shaft 36 are connected to each other. More specifically, the other end of the drive shaft 36 projects from the other end of the stationary sleeve 37, and a drive disk 50 is mounted on the projecting end by means of a connecting knob 49. The disk 50 is connected to the other end of the drum shell 39 by means of a spacer disk 51, which is connected to the drive shaft 36 by means of a key 80. Thus, the driving force of the drive shaft 36 is transmitted to the drum shell 39 via the drive disk 50, whereby the shell 39 is rotated integrally with the shaft 36. In doing this, the drum shell 39 is rotated oppositely to the transportation drum 24 or the drum shell 27.

A pair of suction carriers 52 are mounted on the outer peripheral surface of the drum shell 39. These carriers 52 are separated at a predetermined distance from each other in the axial direction of the drum shell 39, depending on each two filter cigarettes transported on the transportation drum 24. Further, the suction carriers 52 are situated corresponding to the same angular position of the drum shell 39, that is, on the same axis.

Figure 5:
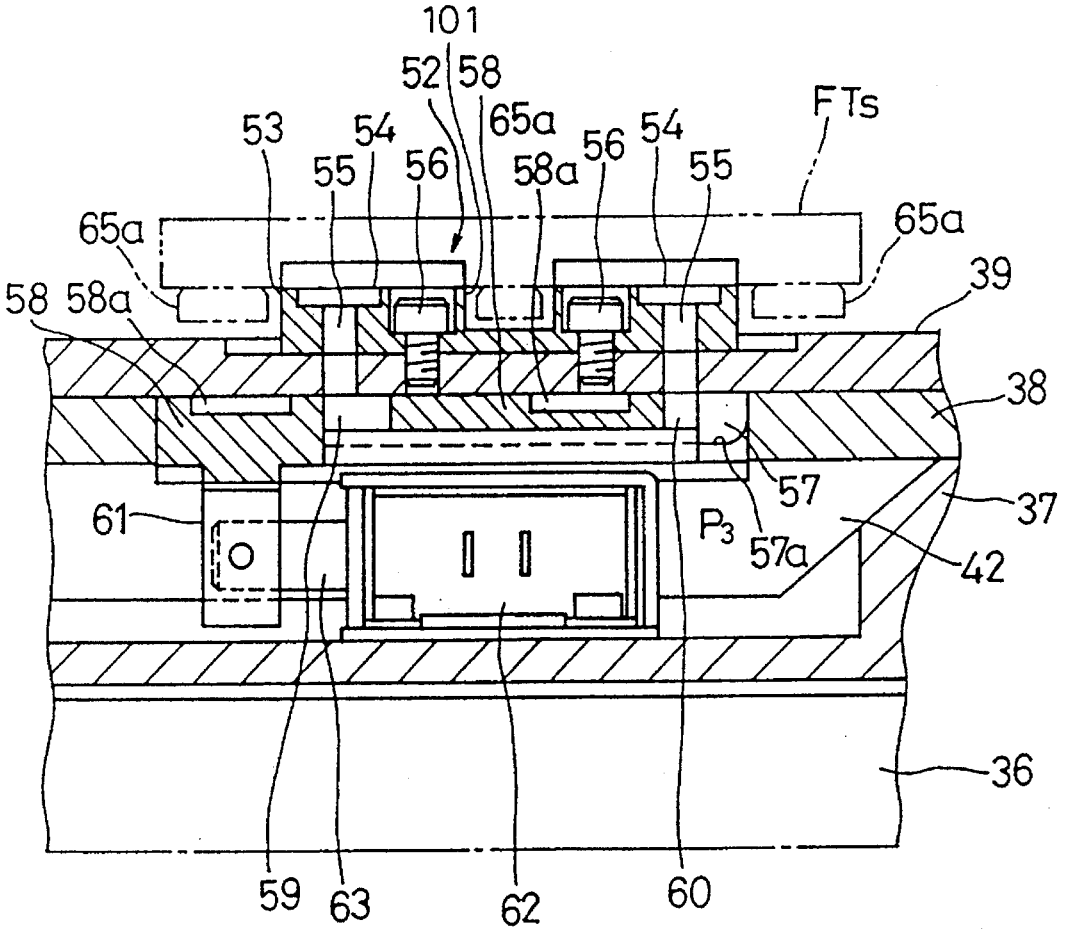
FIG. 5 is an enlarged view showing part of FIG. 4.

The suction carriers 52 have the same construction, and their respective surroundings are also arranged in the same manner. Referring now to FIG. 5, therefore, the arrangements of the one suction carrier 52 and its surroundings will be described.

The suction carrier 52 has a carrier body 53, which is in the form of a rectangular block extending in the axial direction of the drum shell 39. A division groove is formed in the center of the top surface of the carrier body 53, so that the body 53 includes two partial bodies **53*a* and 53*b* which are separated in the axial direction of the drum shell 39**.

A sampling groove 54 is formed on the top surface of the carrier body 53. The sampling groove 54, which has an arcuate cross section, extends in the axial direction of the drum shell 39. One end of each suction hole 55 opens in the bottom of the sampling groove 54. Each hole 55 diametrically penetrates the corresponding partial body and the drum shell 39, and the other end thereof opens in the inner peripheral surface of the shell 39. The one end of each hole 55 is widened.

Mounting screws 56 are screwed into the drum shell 39 through the bottom of the sampling groove 54 and the carrier body 53. The screws 56 fix the carrier body 53 to the drum shell 39. As seen from FIG. 5, the head of each mounting screw 56 is sunk in the carrier body 53 below the bottom level of the sampling groove 5, so that it never projects above the bottom of the groove 54.

The control sleeve 38 is formed having rectangular aperture 57, which communicates with the suction channel 42 or suction path. A shutter 58, which is formed of an arcuate plate, is set in the aperture 57. Thus, the outer surface of the shutter 58 constitutes part of the outer peripheral surface of the control sleeve 38.

Alternatively, the shutter 58 may be located in the suction channel 42. In this case, the outer surface of the shutter 58 constitutes part of the inner peripheral surface of the control sleeve 38.

Figure 6:
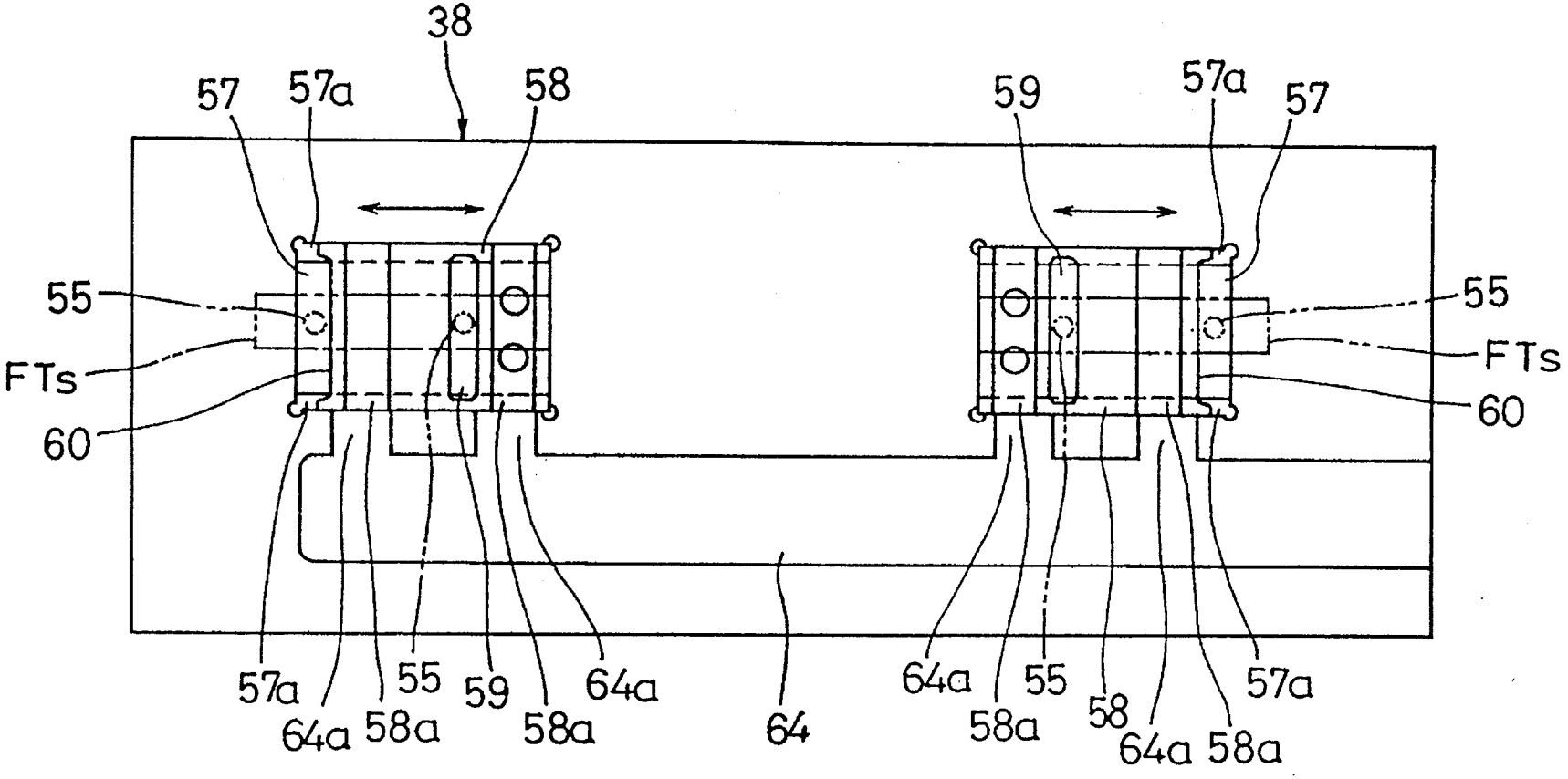
FIG. 6 is a plan view showing a control sleeve of the sampling drum.

As seen from FIG. 6, guides **57*a* are formed individually on the opposite inner edges of the aperture 57 which extends along the axial direction of the control sleeve 38. Guided by these guides 57*a*, the shutter 58 is slidable in the axial direction of the control sleeve 38, that is, in the direction of the arrow in FIG. 6**.

The shutter 58 is formed having a slot 59 which is associated with one suction hole 55 of the suction carrier 52. Also, an end edge of the shutter 58 has an indentation 60 which is associated with the other suction hole 55.

The slot 59 and the indentation 60 have the same length with respect to the circumferential direction of the control sleeve 38, and extend over the same rotational angle zone or third rotational angle zone $\theta_3$ with respect to the rotation of the drum shell 39. The third rotational angle zone $\theta_3$ extends in the rotating direction of the drum shell 39 from the point where the drum shells 27 and 39 are located closest to each other.

As seen from FIG. 5, an arm 61 protrudes integrally from the inner surface of the shutter 58. The arm 61 is coupled to an output shaft 63 of an electromagnetic actuator 62, which has a solenoid therein. When activation of the solenoid is controlled, the output shaft 63 of the actuator 62 is extended or contracted in the axial direction of the control sleeve 38. A casing of the actuator 62 is fixed to the bottom of the suction channel 42. An air cylinder may be used in place of the electromagnetic actuator 62.

In the state shown in FIG. 5, the solenoid of the electromagnetic actuator 62 is energized, so that the output shaft 63 is extended. At this time, the shutter 58 is moved to its open position by the output shaft 63 of the actuator 62. In this open position, the slot 59 and the indentation 60 of the shutter 58 are in positions such that they can be connected to their corresponding suction holes 55 of the suction carrier 52. When the carrier 52 passes the shutter 58 or the third rotational angle zone $\theta_3$ as the drum shell 39 rotates, therefore, the paired suction holes 55 of the carrier 52 are connected to the suction channel 42 through the slot 59 and the indentation 60 of the shutter 58, individually.

When the output shaft 63 of the electromagnetic actuator 62 is contracted, the shutter 58 is moved in the opposite direction to be situated in its closed position. In this closed position, the slot 59 and the indentation 60 of the shutter 58 cannot be connected to their corresponding suction holes 55 of the suction carrier 52. In other words, even though the suction carrier 52 passes the third rotational angle zone $\theta_3$ as the drum shell 39 rotates, both the suction holes 55 of the carrier 52 are kept in the closed state by the outer peripheral surface of the shutter 58. Thus, the suction holes 55 and the suction channel 42 are disconnected at all times.

When the suction carrier 52 passes the shutter 58 in the closed position, the two suction holes 55 of the carrier 52 open individually to a pair of circumferential grooves 58*a* on the outer peripheral surface of the shutter 58.

As shown in FIG. 3, moreover, a release groove 64 is formed on the outer peripheral surface of the control sleeve 38. The groove 64 is situated just in front of the shutter 58 with respect to the rotating direction of the drum shell 39. As seen from FIG. 6, the release groove 64 extend between two shutters 58 in the axial direction of the control sleeve 38, the two shutters 58 are associated with the pair of the suction carriers 52. One end of the groove 64 opens in an end face of the control sleeve 38.

A pair of branch grooves 64*a* extend from the release groove 64 toward each shutter 58. These branch grooves 64*a* are connected to their corresponding circumferential grooves 58*a* of the shutter 58 without regard to the open-close operation of the shutter 58. When the suction carrier 52 passes over the shutter 58 in the closed position, therefore, both the suction holes 55 of the carrier 52 are connected to the release groove 64 through the circumferential grooves 58*a*.

When the paired shutters 58 of the control sleeve 38 are in the open position, the paired suction carriers 52 can cyclically sample the filter cigarettes $FT_S$ transported on the transportation drum 24.

The following is a detailed description of this operation. While the transportation drum 24 and the sampling drum 35 are rotating in opposite directions, the paired suction carriers 52 of the sampling drum 35 cyclically approach the suction grooves 28 of the drum 24 in their corresponding rows at the starting end of the third rotational angle zone $\theta_3$. If the paired shutters 58 are situated in the open position, the respective sampling grooves 54 of the two suction carriers 52 are connected to the slots 59 and the indentations 60 of the shutters 58 through the corresponding suction holes 55, that is, the suction channel 42, and the second suction pressure $P_2$ is supplied to each of the sampling grooves 54.

When the suction grooves 28 of the transportation drum 24 pass the gap G in the second rotational angle zone $\theta_2$, on the other hand, the suction grooves 28 are connected to the gap G by means of the suction holes 29, so that the first suction pressure $P_1$ in the gap G is supplied to the grooves 28. As mentioned before, the second suction pressure $P_2$ is higher than the first suction pressure $P_1$, so that the filter cigarettes $FT_S$ in the suction grooves 28 are sucked out from the grooves 28 by the second suction pressure $P_2$, and attracted to and received by the sampling grooves 54 of the suction carriers 52, overcoming the first suction pressure $P_1$. As the drum shell 39 rotates, thereafter, the filter cigarettes $FT_S$ are transported together with the suction carriers 52. In doing this, the filter cigarettes $FT_S$ are attracted and held by the suction carriers 52 in a manner such that their opposite ends project from the carriers 52.

The attraction of the filter cigarettes $FT_S$ by the suction carriers 52 is continued while the suction carriers 52 or the sampling grooves 54 pass the third rotational angle zone $\theta_3$, that is, as long as the sampling grooves 54 are connected to the slots 59 and the indentations 60 of the shutters 58 through the suction holes 55.

When the suction carriers 52 pass the third rotational angle zone $\theta_3$ so that the suction holes 55 of the carriers 52 are connected to the release groove 64 of the control sleeve 38, thereafter, the attraction of the filter cigarettes $FT_S$ by the carriers 52 is canceled.

When the filter cigarettes $FT_S$ are released from the attraction, they are guided from the suction carriers 52 to their corresponding receiving trays 23, and are collected in the trays 23.

More specifically, collecting guide plates 65 extend upward from the receiving trays 23, respectively. The guide plates 65 connect their corresponding receiving trays 23 and the outer peripheral surface of the sampling drum 35 or the drum shell 39 thereof. The upper end of each guide plate 65 is situated in a region corresponding to the release groove 64 of the control sleeve 38, on the outer peripheral surface of the drum shell 39.

The upper end portion of each collecting guide plate 65 is in the form of a fork having three fingers 65*a*. When each suction carrier 52 reaches the fingers 65*a* of its corresponding guide plate 65 as the drum shell 39 rotates, the outer two of the fingers 65*a* are situated on the opposite sides of their corresponding suction carrier 52, and the center finger in a separation groove 101 of the carrier 52.

Thus, when the attraction by the suction carrier 52 is canceled, the filter cigarettes $FT_S$, which are transported together with the carrier 52 as the drum shell 39 rotates, are taken out in a manner such that they are picked up from the carrier 52 by means of the fingers 65*a* of the corresponding collecting guide plate 65, and are then guided on the guide plate 65 to be delivered to the corresponding receiving tray 23.

The collecting guide plate 65 has a bracket 65*b*, which is rotatably mounted on a support shaft 67. The shaft 67 protrudes from the lower end portion of a stay 66. Thus, when the guide plate 65 is rocked around the support shaft 67, its tilt angle is adjusted. The stay 66 is mounted on the main frame 1.

A support shaft 68 protrudes from the upper end portion of the stay 66, and another bracket 69 is rotatably mounted on the shaft 68. The bracket 69 extends to the region over the sampling drum 35, and a pair of detectors 70 or photoelectric switches, are attached to the distal end of the bracket 69.

When the filter cigarettes $FT_S$, along with the suction carrier 52, pass right under the corresponding detector 70 as the drum shell 39 rotates, this detector 70 detects the passage of the cigarettes $FT_S$, and delivers a detection signal.

The bracket 69 is also rotatable around its support shaft 69, and the emitting angle of detection light from the detector 70 is adjusted as the bracket 69 rotates.

As seen from FIG. 3, moreover, a bottom wall 23*a* of each receiving tray 23 is swingable around a hinge 71.

As shown in FIGS. 3 and 4, a proximity switch 72 is attached to the sampling drum 35 or its stationary sleeve 37, while an element 73 is mounted on an end portion of the drum shell 39. When the element 73 passes the switch 72 as the drum shell 39 rotates, the switch 72 detects this passage, and delivers a detection signal or synchronizing signal.

When sampling the filter cigarettes $FT_S$ from the transportation drum 24 to the sampling drum 35 is started, it is continued as long as the shutters 58 are in the open position. When a predetermined number of filter cigarettes $FT_S$ are collected in each receiving tray 23, however, the corresponding shutter 58 is restored to the closed position, whereupon the filter cigarette sampling is terminated.

Figure 7:
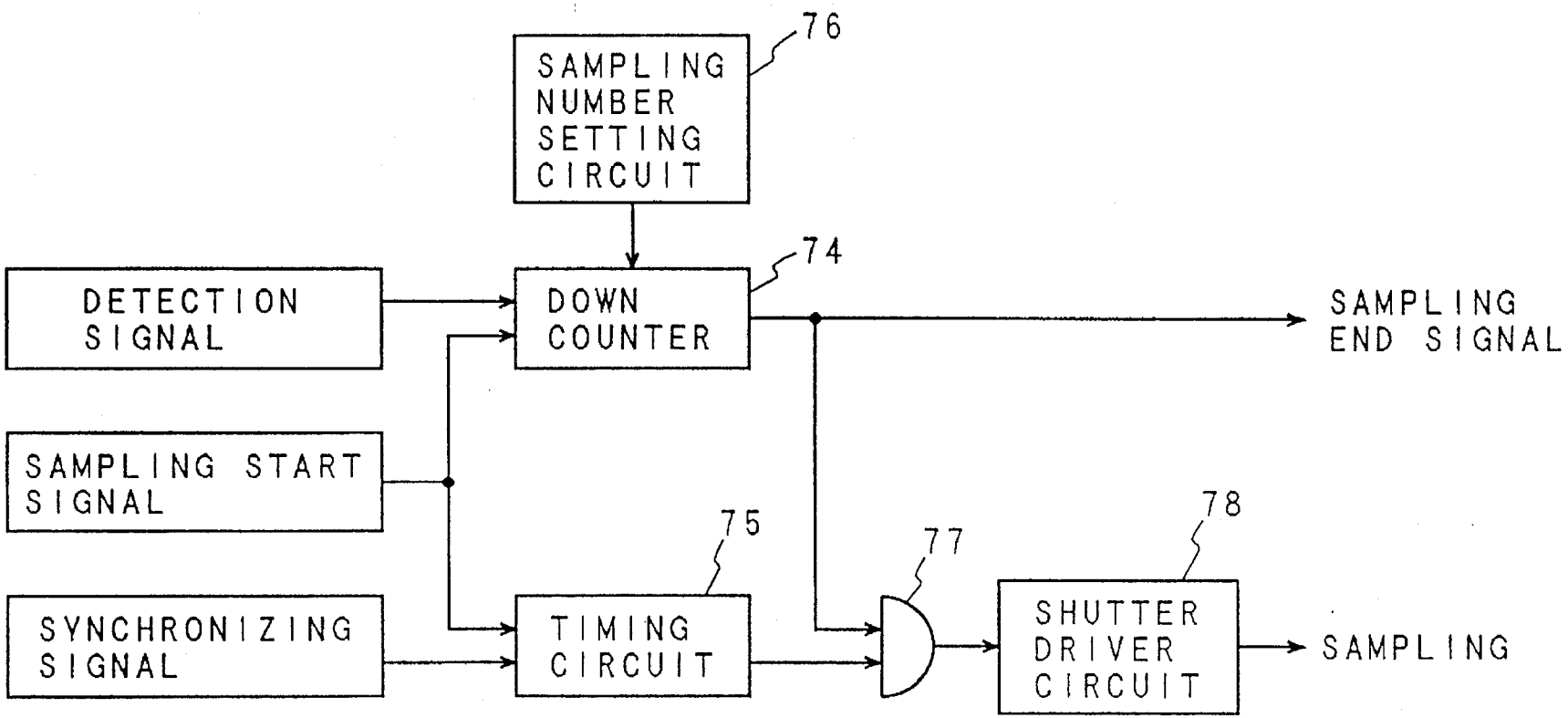
FIG. 7 is a block diagram showing a sampling control circuit for a shutter.

For example, a sampling control circuit for controlling the open-close operation of each shutter 58 is shown in the block diagram of FIG. 7.

As shown in FIG. 7, the detection signal from the detector 70 is applied to the input of a down counter 74, while the synchronizing signal from the proximity switch 72 is supplied to a timing circuit 75. Further, a sampling start signal supplied from an instruction device (not shown) is applied to the respective inputs of the down counter 74 and timing circuit 75.

A sample number setter circuit 76 is connected to the down counter 74. The circuit 76 is used to set the number of filter cigarettes $FT_S$ to be collected in each receiving tray 23, that is, an initial value in the down counter 74.

Meanwhile, the respective outputs of the down counter 74 and the timing circuit 75 are supplied to an AND circuit 77, which is connected to a shutter driver circuit 78.

When the sampling start signal is applied to the down counter 74 and the timing circuit 75, the counter value in the counter 74 is set to the sample number or initial value, whereupon the counter 74 delivers an H-level signal.

After receiving the sampling start signal, on the other hand, the timing circuit 75 delivers an H-level signal on receiving the synchronizing signal from the proximity switch 72, as well as the sampling start signal.

Thus, when the passage of the element 73 is detected by means of the proximity switch 72 after the sampling start signal and the synchronizing signal is delivered from the proximity switch 72 to the timing circuit 75, the respective outputs of the circuit 75 and the down counter 74, that is, inputs of the AND circuit 77, are both on the H-level. As a result, an H-level signal is supplied from the AND circuit 77 to the shutter driver circuit 78. On receiving the H-level signal, the driver circuit 78 energizes the electromagnetic actuator 62 of its corresponding shutter 58 or its solenoid, whereupon the actuator 62 moves the shutter 58 to the open position.

While the sampling drum 35 or the drum shell 39 is rotating, the synchronizing signal from the proximity switch is cyclically applied to the timing circuit 75. As long as the output of the down counter 74 is kept on the H-level, therefore, the shutter driver circuit 78 causes the electromagnetic actuator 62 to keep the corresponding shutter 58 in the open position.

If the shutter 58 is in the open position after the sampling start signal is outputted in this manner, the filter cigarettes $FT_S$ are received from the transportation drum 24 by the sampling grooves 54 of the corresponding suction carrier 52 every time the carrier 52 faces the suction grooves 28 of the drum 24 as the sampling drum 35 rotates. Thereafter, the filter cigarettes $FT_S$ are delivered from the suction carrier 52 into the receiving tray 23 via the collecting guide plate 65.

The filter cigarettes $FT_S$ attracted to the suction carriers 52, on the other hand, are detected by means of the detectors 70, respectively before the carriers 52 pass the fingers **65*a* of the collecting guide plates 65, whereupon the detection signal from each detector 70 is delivered to the down counter 74**.

The counter value in the down counter 74 is decremented by one every time the counter 74 receives the detection signal. When the counter value becomes zero, that is, when the predetermined number of filter cigarettes $FT_S$ are collected in the receiving tray 23, down counter 74 delivers an L-level signal to the AND circuit 77. At this time, therefore, an L-level signal is supplied from the AND circuit 77 to the shutter driver circuit 78, whereupon the circuit 78 stops current supply to the electromagnetic actuator 62. As a result, the shutter 58 is restored to the closed position, and the filter cigarette sampling is stopped thereafter.

Meanwhile, the L-level signal from the down counter 74 is also supplied as a sampling end signal to the aforesaid instruction device. On receiving the sampling end signal, the instruction device turns on a light which is indicative of the termination of the sampling operation.

Thereafter, the predetermined number of filter cigarettes $FT_S$ collected in each receiving tray 23 are weighed by means of scales (not shown), for example, and are subjected to a quality inspection.

The sampling operation and quality inspection for the filter cigarettes $FT_S$ are carried out at regular intervals during the manufacture of the filter cigarettes.

When the shutter 58 is situated in the open position as the sampling start signal is outputted, as described above, the sampling apparatus of the present embodiment can sample the filter cigarettes $FT_S$ from the transportation drum 24 and transfer them to the corresponding suction carrier 52 every time the carrier 52 approaches the drum 24 while the sampling drum 35 is rotating, and this sampling operation is executed cyclically.

Since the shutter 58 constitutes part of the outer peripheral surface of the control sleeve 38, the path which extends from the shutter 58 to each sampling groove 54 of the suction carrier 52, that is, the length of each suction hole 55 of the carrier 52, can be made short enough.

Thus, when the paired suction holes 55 of the suction carrier 52 are connected individually to the slot 59 and the indentation 60 of the shutter 58, the second suction pressure $P_2$ is transmitted immediately to the sampling groove 54 of the carrier 52. In consequence, faulty sampling of the filter cigarettes which is attributable to a time lag required for the transmission of the second suction pressure $P_2$ to the sampling grooves 54 or a time lag required for the opening operation of the shutter 58 itself, can be prevented. Also, the transfer of the filter cigarettes $FT_S$ from the transportation drum 24 to the suction carriers 52 of the sampling drum 35, that is, the filter cigarette sampling, can be effected securely.

According to the sampling manner described herein, an increase of the rotating speed of the transportation drum 24 or the speed of transportation of the filter cigarettes $FT_S$, which must be entailed by the increase of the operating speed of the filter attachment, can be easily tackled to ensure steady sampling by only adjusting the peripheral speed of the sampling drum 35 to that of the transportation drum 24.

Since suction is utilized for the filter cigarette sampling, moreover, the filter cigarettes $FT_S$ cannot be subjected to any substantial impact. While the filter cigarettes are being sampled, therefore, they cannot be damaged, and there is no possibility of cut tobacco from slipping out of the cigarettes. Accordingly, the filter cigarettes $FT_S$ in the receiving trays 23 can undergo an accurate quality inspection.

The present invention is not limited to the one embodiment described above, and various modifications may be effected therein. In the one embodiment, for example, each shutter 58 is situated in the open position after the sampling start signal is outputted, so that the filter cigarettes $FT_S$ are extracted every time the sampling drum 35 makes one revolution. If the arrangement is such that each shutter 58 is restored to the closed position after one filter cigarette $FT_S$ is sampled, however, the filter cigarettes $FT_S$ can be sampled every time the sampling drum 35 makes a desired number of revolutions.

In the foregoing embodiment, moreover, the gap G for producing the first suction pressure $P_1$ is provided between the drum shell 27 and the stationary sleeve 26 of the transportation drum 24. If this gap G is not provided, however, the second suction pressure $P_2$ is set at a value higher than the line suction pressure $P_L$ on the side of the transportation drum 24.

What is claimed is:

1. An apparatus for sampling manufactured filter cigarettes from a conveyor line thereof, the conveyor line transporting the filter cigarettes, said apparatus comprising:

a transportation drum rotatably located in the conveyor line, said transportation drum transporting received filter cigarettes while attracting the filter cigarettes under a first suction pressure;

a sampling drum rotatably arranged in the vicinity of said transportation drum, said sampling drum having a sampling groove capable of periodically approaching one of the filter cigarettes transported on said transportation drum to receive the filter cigarette while said sampling drum is rotating;

supply means for supplying a second suction pressure to the sampling groove as the sampling groove passes a predetermined rotational angle zone on the side of said transportation drum while said sampling drum is rotating, said supply means including a suction channel defined in said sampling drum and connected to the sampling groove;

differential pressure means for producing a differential pressure between a positive suction pressure on said transportation drum and the second suction pressure in the sampling groove as the sampling groove passes the rotational angle zone, the filter cigarette on said transportation drum being attracted and received by the sampling groove on the basis of the differential pressure, wherein said positive suction pressure is a suction pressure greater than zero;

release means for removing the second suction pressure in the sampling groove after the rotational angle zone is passed by the sampling groove;

collecting means for collecting the filter cigarette in the sampling groove from said sampling drum after the second suction pressure in the sampling groove is removed; and valve means for opening and closing the suction channel of said supply means;

wherein said sampling drum includes a rotatable drum shell having the sampling groove and a control sleeve fixed in the drum shell, the drum shell rotating in a manner such that an inner peripheral surface thereof is airtightly in sliding contact with an outer peripheral surface of the control sleeve, and the suction channel includes a suction hole, formed in the drum shell and having one end opening into the sampling groove and another end opening in the inner peripheral surface of the drum shell, and an aperture defined in the control sleeve and opening over the rotational angle zone, the aperture being opened and closed by said valve means;

wherein said valve means includes an arcuate shutter constituting part of the outer peripheral surface of the control sleeve and being movable in an axial direction of the control sleeve, and an actuator in the control sleeve for moving the shutter to open and close the aperture;

wherein said valve means further includes a circumferential groove formed on the outer surface of the shutter and connecting means for connecting the circumferential groove to the atmosphere, and the suction hole of the drum shell passes the circumferential groove of the shutter as the drum shell rotates when the shutter is in a position to close the aperture.

2. An apparatus according to claim 1, which further comprises detecting means for detecting the filter cigarette received in the sampling groove of said sampling drum and delivering detection signals, counting means for counting the sampled filter cigarettes on the basis of the detection signals from said detecting means, and drive means for causing said valve means to close the suction channel when a set value is attained by the number of sampled filter cigarettes counted by said counting means.

3. An apparatus according to claim 1, wherein said transportation drum includes a rotatable drum shell, having transportation grooves on the outer peripheral surface thereof for receiving the filter cigarettes and a suction hole having one end opening in the bottom of the transportation groove and the other end opening in the inner peripheral surface of the drum shell, and a stationary sleeve fixed in the drum shell and having an aperture in the outer peripheral surface thereof passing sampling drum in the circumferential direction and receiving the first suction pressure, and said differential pressure means includes a throttle wall in the aperture of the stationary sleeve, the throttle wall facing the inner peripheral surface of the drum shell across a gap, the gap producing the positive suction pressure.

4. An apparatus for sampling manufactured filter cigarettes from a conveyor line thereof, the conveyor line transporting the filter cigarettes, said apparatus comprising:

a transportation drum including a drum shell having a plurality of suction grooves rotatably located in the conveyor line, said transportation drum transporting received filter cigarettes while attracting the filter cigarettes under a first suction pressure;

a sampling drum rotatably arranged in the vicinity of said transportation drum, said sampling drum having a sampling groove capable of periodically approaching one of the filter cigarettes transported on said transportation drum to receive the filter cigarette while said sampling drum is rotating;

supply means for supplying a second suction pressure to the sampling groove as the sampling groove passes a predetermined rotational angle zone on the side of said transportation drum while said sampling drum is rotating, said supply means including a suction channel defined in said sampling drum and connected to the sampling groove;

suction pressure reducing means for reducing the first suction pressure on said transportation drum to a third suction pressure when the filter cigarette on said transportation drum passes over said sampling drum so that a differential pressure between the third suction pressure and the second suction pressure in the sampling groove is produced, said suction pressure reducing means including a suction chamber defined in said transportation drum and supplied with the first suction pressure and a throttle wall disposed inside of said drum shell of the transportation drum so as to define a gap which forms a communication between the suction chamber and a suction groove of the drum shell in order to produce the third suction pressure, and the filter cigarette on said transportation drum being attracted and received by the sampling groove on the basis of the differential pressure;

release means for removing the second suction pressure in the sampling groove after the rotational angle zone is passed by the sampling groove; and collecting means for collecting the filter cigarette in the sampling groove from said sampling drum after the second suction pressure in the sampling groove is removed.

5. An apparatus according to claim 4, which further comprises valve means for opening and closing the suction channel of said supply means.

6. An apparatus according to claim 5, wherein said sampling drum includes a rotatable drum shell having the sampling groove and a control sleeve fixed in the drum shell, the drum shell rotating in a manner such that the inner peripheral surface thereof is airtightly in sliding contact with the outer peripheral surface of the control sleeve, and the suction channel includes a suction hole, formed in the drum shell and having one end opening into the sampling groove and the other end opening in the inner peripheral surface of the drum shell, and an aperture defined in the control sleeve and opening over the rotational angle zone, the aperture being opened and closed by said valve means.

7. An apparatus according to claim 6, wherein said valve means includes an arcuate shutter constituting part of the outer peripheral surface of the control sleeve and being movable in the axial direction of the control sleeve, and an actuator in the control sleeve for moving the shutter to open and close the aperture.

8. An apparatus according to claim 7, wherein said valve means further includes a circumferential groove formed on the outer surface of the shutter and connecting means for connecting the circumferential groove to the atmosphere, and the suction hole of the drum shell passes the circumferential groove of the shutter as the drum shell rotates when the shutter is in a position to close the aperture.

9. An apparatus according to claim 8, wherein the release means includes a release groove formed on the control sleeve and communicated with the atmosphere, and the connecting means includes branch grooves diverging from the release groove and connected to the circumferential groove of the shutter.

* * * * *